US011087711B2

(12) United States Patent
Dong et al.

(10) Patent No.: US 11,087,711 B2
(45) Date of Patent: Aug. 10, 2021

(54) COMMON VOLTAGE COMPENSATION CIRCUIT, DISPLAY DRIVER AND DISPLAY DEVICE

(71) Applicants: Beijing BOE Display Technology Co., Ltd., Beijing (CN); BOE TECHNOLOGY GROUP CO., LTD., Beijing (CN)

(72) Inventors: Dianzheng Dong, Beijing (CN); Weitao Chen, Beijing (CN); Xiaopeng Cui, Beijing (CN); Wenpeng Xu, Beijing (CN); Wan Lin, Beijing (CN); Haixu Wang, Beijing (CN)

(73) Assignees: Beijing BOE Display Technology Co., Ltd., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/966,871

(22) PCT Filed: Dec. 4, 2019

(86) PCT No.: PCT/CN2019/122968

§ 371 (c)(1),
(2) Date: Jul. 31, 2020

(87) PCT Pub. No.: WO2020/140673

PCT Pub. Date: Jul. 9, 2020

(65) Prior Publication Data

US 2021/0043156 A1 Feb. 11, 2021

(30) Foreign Application Priority Data

Jan. 2, 2019 (CN) ..... 201910002330.7

(51) Int. Cl.
*G09G 3/36* (2006.01)

(52) U.S. Cl.
CPC ... *G09G 3/3696* (2013.01); *G09G 2310/0286* (2013.01); *G09G 2310/0291* (2013.01); *G09G 2310/08* (2013.01)

(58) Field of Classification Search
CPC ..... G09G 3/3696; G09G 2310/0286; G09G 2310/0291; G09G 2310/08; G09G 3/3655; G09G 3/36
See application file for complete search history.

(56) References Cited

U.S. PATENT DOCUMENTS 6,930,667 B1 * 8/2005 Iijima ..... G09G 3/3622 345/101
2005/0140400 A1 6/2005 Yi et al.
(Continued)

FOREIGN PATENT DOCUMENTS

CN 101311779 A 11/2008
CN 103531168 A 1/2014
(Continued)

OTHER PUBLICATIONS

China Patent Office, First Office Action dated Jan. 2, 2020 for application No. CN201910002330.7.
(Continued)

*Primary Examiner* — Andrew Sasinowski
(74) *Attorney, Agent, or Firm* — Houtteman Law LLC

(57) ABSTRACT

The present disclosure provides a common voltage compensation circuit including a feedback signal input terminal and a compensation sub-circuit. The compensation sub-circuit is configured to generate a compensation voltage for compensating a common voltage according to a feedback signal from the feedback signal input terminal and a reference common voltage. The common voltage compensation circuit also includes a first filter sub-circuit, a first terminal of the first filter sub-circuit is electrically coupled to the feedback signal input terminal, and a second terminal of the first filter
(Continued)

sub-circuit is electrically coupled to a first clock signal line. The feedback signal line arranged is adjacent to a second clock signal line, and a first clock signal in the first clock signal line and a second clock signal in the second clock signal line are inverted relative to each other. The present disclosure also provides a display driver and a display device.

20 Claims, 4 Drawing Sheets

(56) References Cited

U.S. PATENT DOCUMENTS

| | | | | |
|---|---|---|---|---|
| 2016/0019840 | A1* | 1/2016 | Cao | G09G 3/3233 345/214 |
| 2017/0004790 | A1* | 1/2017 | Kitsomboonloha | G09G 3/3648 |
| 2020/0097112 | A1* | 3/2020 | Seo | G06F 3/0412 |

FOREIGN PATENT DOCUMENTS

| | | | |
|---|---|---|---|
| CN | 105390107 | A | 3/2016 |
| CN | 106023877 | A | 10/2016 |
| CN | 109712581 | A | 5/2019 |

OTHER PUBLICATIONS

China Patent Office, Socond Office Action dated Jul. 16, 2020 for application No. CN201910002330.7.

* cited by examiner

COMMON VOLTAGE COMPENSATION CIRCUIT, DISPLAY DRIVER AND DISPLAY DEVICE

CROSS-REFERENCE TO RELATED APPLICATION

The present application claims priority from the Chinese patent application No. 201910002330.7 filed on Jan. 2, 2019, the entirety of which is incorporated herein by reference.

TECHNICAL FIELD

The present disclosure relates to the field of display technology, in particular to a common voltage compensation circuit, a display driver including the common voltage compensation circuit and a display device including the display driver.

BACKGROUND

Liquid crystal display devices are widely used due to advantages such as low power consumption. The performance of the liquid crystal display device affects the display effect.

SUMMARY

The present disclosure provides a common voltage compensation circuit, a display driver including the common voltage compensation circuit, and a display device including the display driver.

As an aspect of the present disclosure, there is provided a common voltage compensation circuit including a feedback signal input terminal and a compensation sub-circuit, the feedback signal input terminal being electrically coupled to a feedback signal line and the compensation sub-circuit and being configured to receive a feedback signal related to a common voltage from the feedback signal line and to provide the received feedback signal to the compensation sub-circuit, the compensation sub-circuit being configured to generate a compensation voltage for compensating the common voltage according to the received feedback signal and a reference common voltage. The common voltage compensation circuit also includes a first filter sub-circuit, a first terminal of the first filter sub-circuit is electrically coupled to the feedback signal input terminal, and a second terminal of the first filter sub-circuit is electrically coupled to a first clock signal line. The feedback signal line is arranged adjacent to a second clock signal line, and a first clock signal in the first clock signal line and a second clock signal in the second clock signal line are signals inverted relative to each other.

In an embodiment, the first filter sub-circuit includes a first resistor and a first capacitor, one terminal of the first resistor is formed as the first terminal of the first filter sub-circuit and is electrically coupled to the feedback signal input terminal, the other terminal of the first resistor is electrically coupled to one terminal of the first capacitor, and the other terminal of the first capacitor is formed as the second terminal of the first filter sub-circuit and is electrically coupled to the first clock signal line.

In an embodiment, the compensation sub-circuit includes an operational amplifier, an inverting input of the operational amplifier is electrically coupled to the feedback signal input terminal, and a non-inverting input of the operational amplifier is configured to receive the reference common voltage.

In an embodiment, the common voltage compensation circuit further includes a second filter sub-circuit, a first terminal of the second filter sub-circuit being electrically coupled to the feedback signal input terminal, and a second terminal of the second filter sub-circuit being electrically coupled to a third clock signal line. The second clock signal line is located between the feedback signal line and a fourth clock signal line, and a third clock signal in the third clock signal line and a fourth clock signal in the fourth clock signal line are signals inverted relative to each other.

In an embodiment, the second filter sub-circuit includes a second resistor and a second capacitor, one terminal of the second resistor is formed as the first terminal of the second filter sub-circuit and is electrically coupled to the feedback signal input terminal, the other terminal of the second resistor is electrically coupled to one terminal of the second capacitor, and the other terminal of the second capacitor is formed as the second terminal of the second filter sub-circuit and is electrically coupled to the third clock signal line.

In an embodiment, the compensation sub-circuit includes an operational amplifier, an inverting input of the operational amplifier is electrically coupled to the feedback signal input terminal, and a non-inverting input of the operational amplifier is configured to receive the reference common voltage.

As another aspect of the present disclosure, there is provided a display driver including the common voltage compensation circuit described above.

In an embodiment, the display driver further includes a clock signal generation sub-circuit, the clock signal generation sub-circuit includes a first clock signal terminal electrically coupled to the first clock signal line, and the second terminal of the first filter sub-circuit is electrically coupled to the first clock signal line by being electrically coupled to the first clock signal terminal.

In an embodiment, the clock signal generation sub-circuit and the common voltage compensation circuit are integrated in one chip.

As another aspect of the present disclosure, there is provided a display device including a display panel and the display driver described above, and the display driver is configured to drive the display panel. The display panel includes the feedback signal line, the first clock signal line, and the second clock signal line.

In an embodiment, the display panel includes a display region and a peripheral region outside the display region, the first clock signal line, the second clock signal line, and the feedback signal line are in the peripheral region, the second clock signal line is on a side of the first clock signal line distal to the display region, and the feedback signal line is on a side of the second clock signal line distal to the display region.

In an embodiment, the feedback signal line is parallel to the second clock signal line.

BRIEF DESCRIPTION OF THE DRAWINGS

The accompanying drawings are used to provide a further understanding of the present disclosure, and constitute a part of the specification. The accompanying drawings are used to explain the present disclosure together with the following specific embodiments, but do not limit the present disclosure. In the accompanying drawings.

DETAILED DESCRIPTION

Specific embodiments of the present disclosure will be described in detail below with reference to the drawings. It should be understood that the specific embodiments described herein are only used to illustrate and explain the present disclosure, and are not intended to limit the present disclosure.

Figure 1:
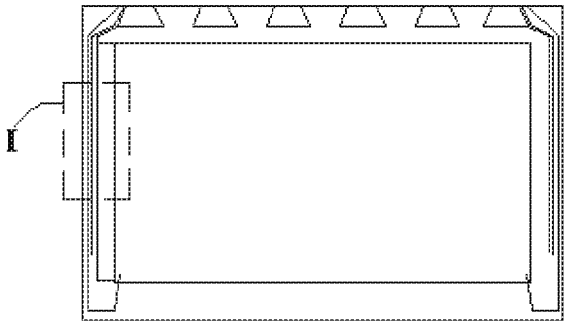
FIG. 1 is a schematic diagram of a display panel in the art.
Figure 2:
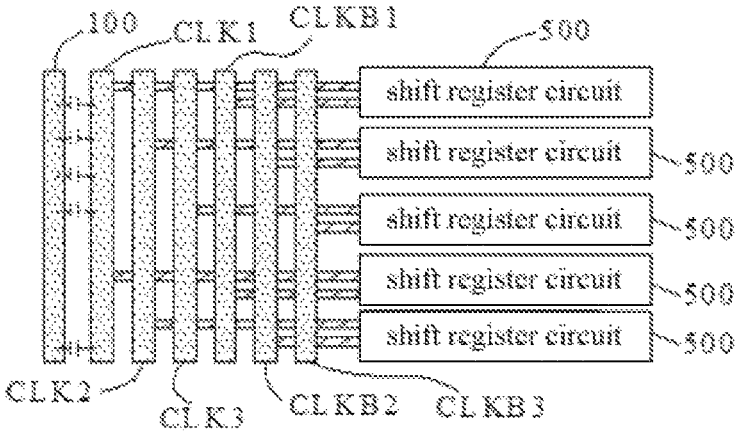
FIG. 2 is an enlarged view of a region I of FIG. 1.
Figure 3:
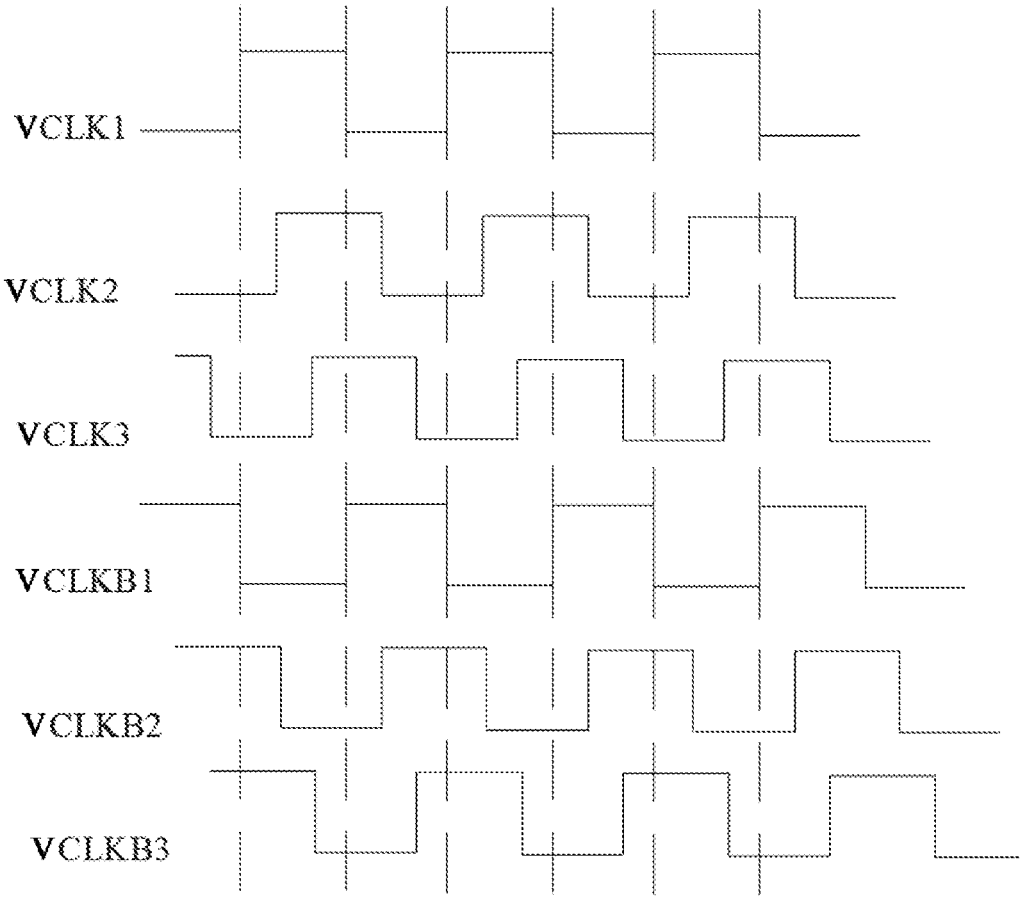
FIG. 3 is a timing diagram of clock signals driving the display panel of FIG. 1.
Figure 4:
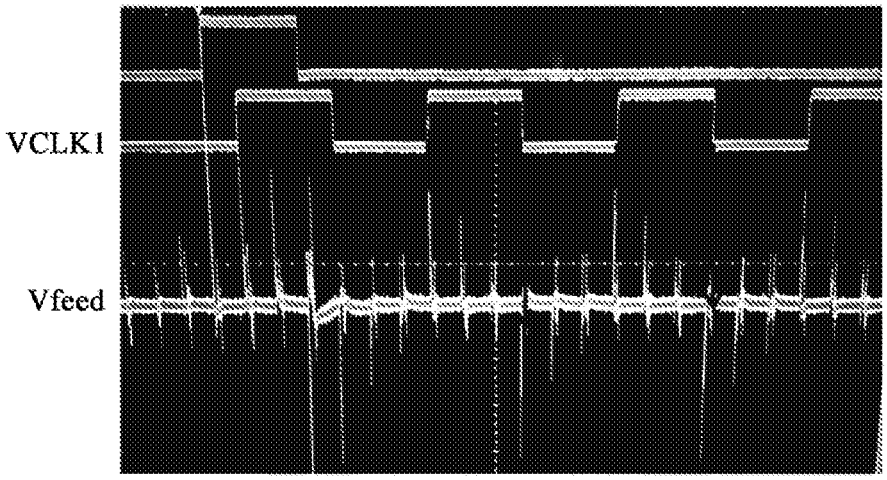
FIG. 4 is a signal waveform diagram during the display panel of FIG. 1 is tested.

FIG. 1 is a schematic diagram of a display panel, FIG. 2 is an enlarged view of a region I of FIG. 1, FIG. 3 is a timing diagram of clock signals driving the display panel of FIG. 1, and FIG. 4 is a signal waveform diagram during the display panel of FIG. 1 is tested.

As shown in FIGS. 1 and 2, the display panel includes: a feedback signal line 100, a first clock signal line CLKB1, a second clock signal line CLK1, a third clock signal line CLKB2, a fourth clock signal line CLK2, a fifth clock signal line CLKB3, a sixth clock signal line CLK3, and a shift register including a plurality of shift register circuits 500. In some cases, the display panel includes a display region and a peripheral region, and the region I is in the peripheral region.

In the display panel, a voltage (hereinafter, referred to as a "common voltage") on a common electrode (not shown) in the display panel is sampled by using the feedback signal line 100, and the voltage on the common electrode is compensated using a sampled signal Vscom (which is substantially equal to the common voltage) sampled by the feedback signal line 100 and a reference common voltage Vref (Vcom), so that the voltage on the common electrode is always kept stable.

In the display panel, during an operation of driving the display panel, the shift register provides scan signals to respective rows of a pixel array of the display panel sequentially. As shown in FIG. 2, the shift register includes a plurality of shift register circuits 500 in cascade, each of the plurality of shift register circuits is provided to a clock signal so that the shift register circuits generate the scan signals which are respectively provided to the rows of the pixel array, respectively.

In some cases, as shown in FIGS. 2 and 3, the shift register circuits are divided into three groups, a first clock signal VCLKB1 and a second clock signal VCLK1, which are inverted signals with respect to each other, are supplied to (1+3n)-th shift register circuits through the first clock signal line CLKB1 and the second clock signal line CLK1, respectively, a third clock signal VCLKB2 and a fourth clock signal VCLK2, which are inverted signals with respect to each other, are supplied to (2+3n)-th shift register circuits through the third clock signal line CLKB2 and the fourth clock signal line CLK2, respectively, and a fifth clock signal VCLKB3 and a sixth clock signal VCLK3, which are inverted signals with respect to each other, are supplied to (3+3n)-th shift register circuits through the fifth clock signal line CLKB3 and the sixth clock signal line CLK 3, respectively. It is noted that N is a natural number.

In some cases, as shown in FIG. 2, the feedback signal line 100 is disposed adjacent to the second clock signal line CLK1, and thus a coupling capacitance is formed between the feedback signal line 100 and the second clock signal line CLK 1. In this case, during an operation of the display panel, the second clock signal in the second clock signal line CLK1 may interfere with the sampled signal Vscom sampled by the feedback signal line 100, so that there is a deviation between a feedback signal Vfeed finally output from the feedback signal line 100 and the sampled signal Vscom sampled by the feedback signal line 100 from the common electrode, which may cause the effect of compensating the common voltage to be at least weakened, and may cause the common voltage to be unable to remain stable.

For example, as shown in FIG. 4, the feedback signal Vfeed has large fluctuations at the rising and falling edges of the second clock signal VCLK1 in the second clock signal line CLK 1. In other words, under the influence of the second clock signal, the feedback signal Vfeed in the feedback signal line 100 may not faithfully reflect the common voltage on the common electrode of the display panel, which may cause the effect of compensating the common voltage to be at least weakened, and may further cause horizontal stripes to appear on the screen displayed by the display panel.

Figure 5:
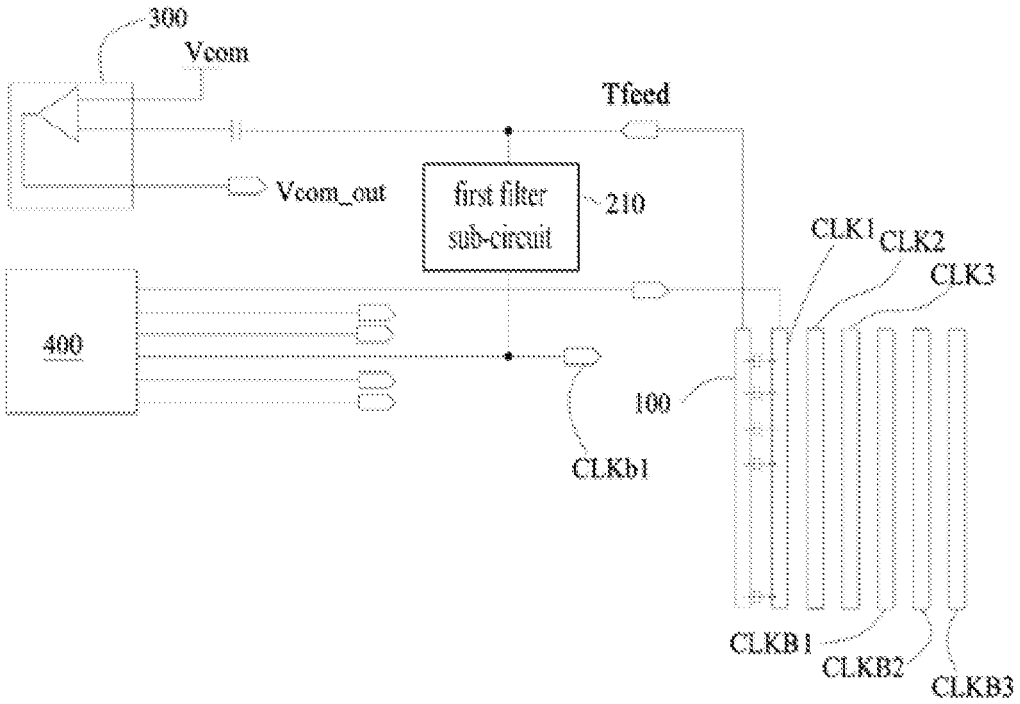
FIG. 5 illustrates a schematic diagram of a common voltage compensation circuit according to an embodiment of the present disclosure.
Figure 6:
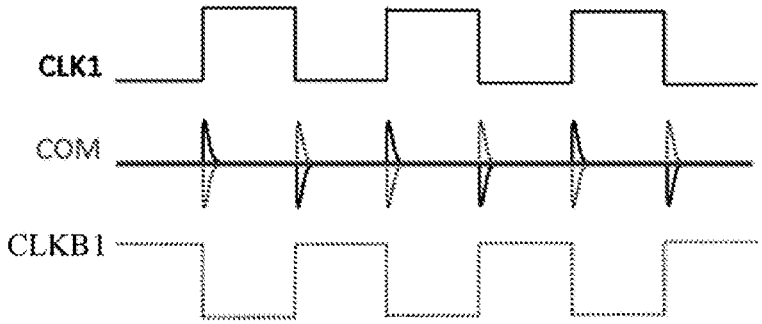
FIG. 6 is a schematic diagram illustrating a principle of eliminating interference of a clock signal line on a feedback signal by using a common voltage compensation circuit according to an embodiment of a present disclosure.
Figure 7:
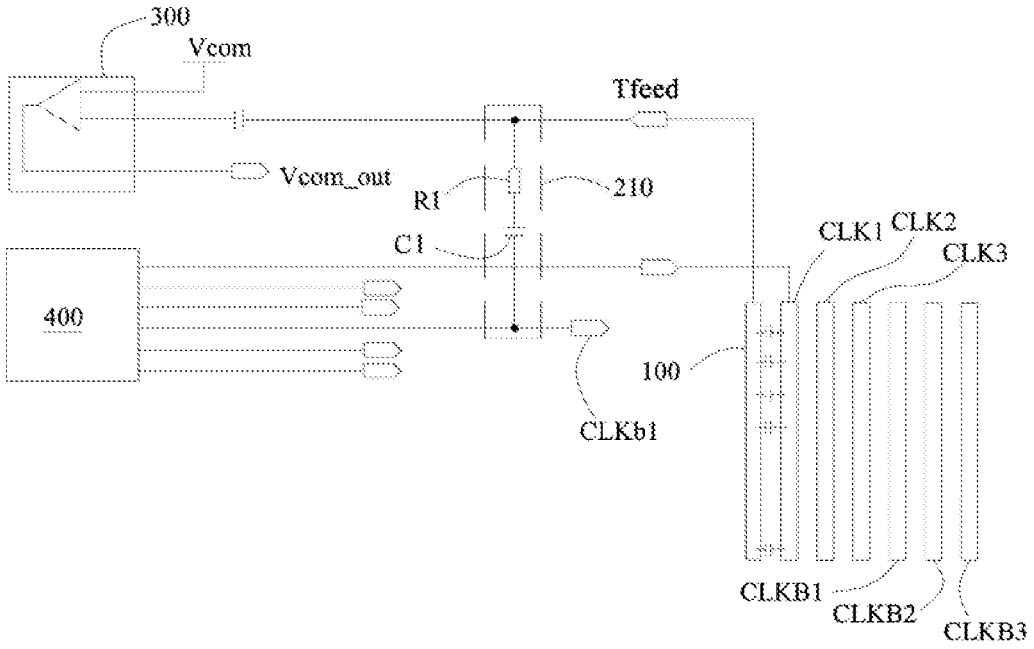
FIG. 7 illustrates a circuit schematic diagram of a filter sub-circuit of a common voltage compensation circuit according to an embodiment of the present disclosure.

In order to solve the above technical problem, an embodiment of the present disclosure provides a common voltage compensation circuit. FIG. 5 illustrates a schematic diagram of a common voltage compensation circuit according to an embodiment of the present disclosure, FIG. 6 is a schematic diagram illustrating the principle of eliminating the interference of a clock signal line on a feedback signal by using a common voltage compensation circuit according to an embodiment of a present disclosure, FIG. 7 illustrates a circuit schematic diagram of a filter sub-circuit of a common voltage compensation circuit according to an embodiment of the present disclosure.

As shown in FIG. 5, the common voltage compensation circuit according to the embodiment of the present disclosure includes a feedback signal input terminal Tfeed and a compensation sub-circuit 300. The feedback signal input terminal Tfeed is electrically coupled to the feedback signal line 100 and the compensation sub-circuit 300, and is configured to receive the feedback signal Vfeed provided by the feedback signal line 100 and to provide the received feedback signal Vfeed to the compensation sub-circuit 300. The compensation sub-circuit 300 is configured to generate a compensation voltage Vcom_out for compensating the common voltage on the common electrode according to the received feedback signal Vfeed and the reference common voltage Vref (Vcom).

As shown in FIG. 5, the common voltage compensation circuit according to the embodiment of the present disclosure further includes a first filter sub-circuit 210. A first terminal of the first filter sub-circuit 210 is electrically coupled to the feedback signal input terminal Tfeed, and a second terminal of the first filter sub-circuit 210 is electrically coupled to the first clock signal line CLKB 1. In this case, a capacitance is formed between the first terminal of the first filter sub-circuit 210 and the second terminal of the first filter sub-circuit 210.

As shown in FIGS. 2 and 5, in the display panel, the second clock line CLK1 is adjacent to the feedback line 100, and as described above, the first clock signal in the first clock line CLKB1 and the second clock signal in the second clock line CLK1 are inversed signals with regard to each other. It is noted that, for the sake of clarity, only the respective clock signal lines in the display panel are shown in FIG. 5, and the shift register circuits and the like are omitted.

Since a capacitance is formed between the first terminal of the first filter sub-circuit 210 and the second terminal of the first filter sub-circuit 210, the first terminal of the first filter sub-circuit 210 is electrically coupled to the feedback signal input terminal Tfeed, and the second terminal of the first filter sub-circuit 210 is electrically coupled to the first clock signal line CLKB1, during an operation of a display device including a display panel and the common voltage compensation circuit according to the embodiment of the present disclosure, charging and discharging of the capacitance between the first terminal of the first filter sub-circuit 210 and the second terminal of the first filter sub-circuit 210 is affected by the first clock signal in the first clock signal line CLKB1 electrically coupled to the first filter sub-circuit 210, and the charging and discharging of the capacitance between the first terminal of the first filter sub-circuit 210 and the second terminal of the first filter sub-circuit 210 may affect the signal in the feedback signal line 100.

In this case, since the first clock signal and the second clock signal are inverted signals with regard to each other, as shown in FIG. 6, the influence of the second clock signal in the second clock signal line CLK1 on the signal in the feedback signal line 100 is reverse to the influence of the first clock signal in the first clock signal line CLKB1 on the signal in the feedback signal line 100. Therefore, the influence of the first clock signal on the signal in the feedback signal line 100 and the influence of the second clock signal on the signal in the feedback signal line 100 may at least partially cancel each other out, so that it may be ensured that the feedback signal Vfeed output from the feedback signal line 100 become more consistent with the sampled signal Vscom sampled from the common electrode by the feedback signal line 100. In other words, the feedback signal Vfeed output from the feedback signal line 100 become more consistent with the common voltage on the common electrode.

Since the feedback signal Vfeed output from the feedback signal line 100 become more consistent with the sampled signal Vscom sampled from the common electrode by the feedback signal line 100 by using the common voltage compensation circuit according to the embodiment of the present disclosure, that is, the feedback signal Vfeed output from the feedback signal line 100 become more consistent with the common voltage on the common electrode, the effect of compensating the common voltage by using the feedback signal Vfeed output from the feedback signal line 100 is enhanced, the common voltage on the common electrode can be always kept stable, and thus the appearance of horizontal stripes on the screen displayed by the display panel can be relieved or avoided.

In some embodiments, as shown in FIG. 5, the second terminal of the first filter sub-circuit 210 may be electrically coupled to the first clock signal line CLKB1 by being electrically coupled to a first clock signal terminal CLKb1 electrically coupled to the first clock signal line CLKB1, but the disclosure is not limited thereto. For example, in some embodiments, the second terminal of the first filtering sub-circuit 210 may be directly electrically coupled to the first clock signal line CLKB1.

In some embodiments, as shown in FIG. 7, the first filter sub-circuit 210 includes a resistor R1 and a capacitor C1, one terminal of the resistor R1 is formed as the first terminal of the first filter sub-circuit 210 to be electrically coupled to the feedback signal input terminal, the other terminal of the resistor R1 is electrically coupled to one terminal of the capacitor C1, and the other terminal of the capacitor C1 is formed as the second terminal of the first filter sub-circuit 210 to be electrically coupled to the first clock signal terminal CLKb1. It should be understood that the circuit structure of the first filter sub-circuit 210 according to the embodiment of the present disclosure is not limited to the case shown in FIG. 7. For example, in some embodiments, the capacitor C1 may be replaced with a reverse biased diode.

In the case as shown in FIG. 7, the values of the resistor R1 and the capacitor C1 in the first filter sub-circuit 210 may be calculated based on parameters of the second clock signal using the following equations (1) and (2).

$$f = \frac{1}{2\pi RC} \tag{1}$$

$$Vfeed = V(1 - e^{t/RC}) \tag{2}$$

In the equations (1) and (2), R is a resistance value of the resistor R1, C is a capacitance value of the capacitor C1, f is a frequency of the second clock signal, Vfeed is the feedback signal output from the feedback signal line 100, V is a difference between high and low levels of the second clock signal, and t is a duration of the high level during a single period of the second clock signal.

In some embodiments, the resistance of the resistor R1 may be ranged from 100 ohms to 1000 ohms.

In some embodiments, in order to accurately compensate the common voltage, the compensation sub-circuit 300 includes an operational amplifier. An inverting input of the operational amplifier is electrically coupled to the feedback signal input terminal Tfeed, and a non-inverting input of the operational amplifier is configured to receive the reference common voltage Vref (Vcom). The compensation sub-circuit 300 compares the feedback signal Vfeed received from the feedback signal input terminal Tfeed and output by the feedback signal line 100 with the reference common voltage Vref, and obtains and outputs the compensation voltage Vcom_out for compensating the common voltage based on the result of the comparison.

Figure 8:
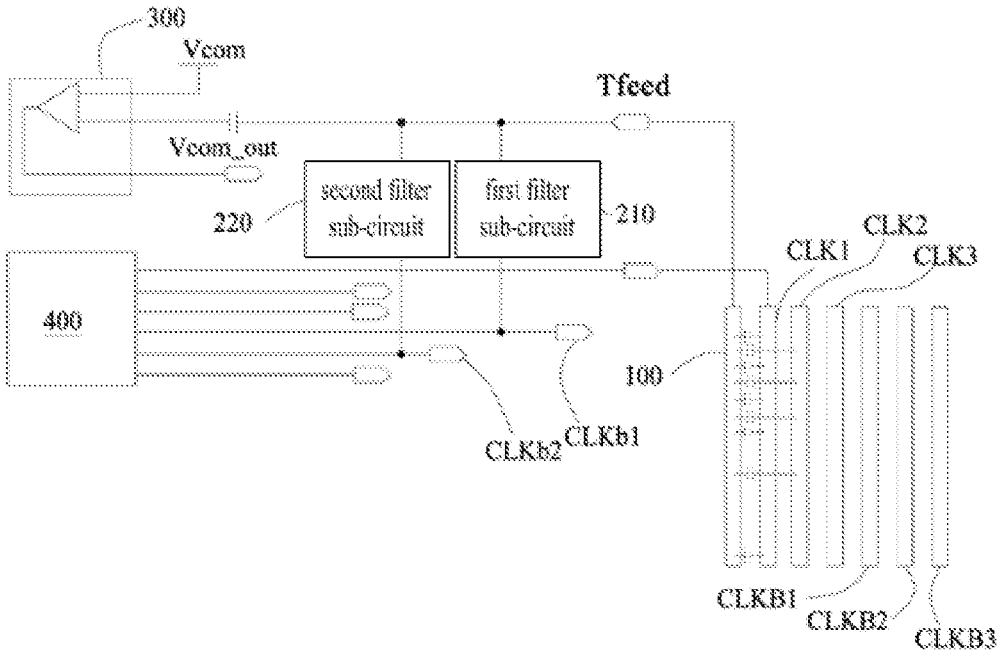
FIG. 8 illustrates a schematic diagram of a common voltage compensation circuit according to an embodiment of the present disclosure.

FIG. 8 illustrates a schematic diagram of a common voltage compensation circuit according to an embodiment of the present disclosure. The description have been given with reference to FIG. 5 will be omitted.

In some embodiments, in addition to the influence of the second clock signal in the second clock signal line CLK1 adjacent to the feedback signal line 100 on the sampled signal Vscom in the feedback signal line 100, the fourth clock signal in the fourth clock signal line CLK2 adjacent to the second clock signal line CLK1 (as shown in FIGS. 5, 7, and 8, the second clock signal line CLK1 is located between the feedback signal line 100 and the fourth clock signal line CLK 2) may also influence the sampled signal Vscom in the feedback signal line 100.

In some embodiments, in order to eliminate the influence of the fourth clock signal line CLK2 on the signal in the feedback signal line 100, as shown in FIG. 8, the common voltage compensation circuit may further include a second filter sub-circuit 220, a first terminal of the second filter sub-circuit 220 is electrically coupled to the feedback signal input terminal Tfeed, and a second terminal of the second filter sub-circuit 220 is electrically coupled to the third clock signal line CLKB2. As described above, the third clock signal in the third clock line CLKB2 and the fourth clock signal in the fourth clock line CLK2 are inverse signals with regard to each other.

In this case, similar to the first filter sub-circuit, a capacitance is also formed between the first terminal of the second filter sub-circuit 220 and the second terminal of the second filter sub-circuit 220. The charging and discharging of the capacitance between the first and second terminals of the second filter sub-circuit 220 is influenced by the third clock signal, and the charging and discharging of the capacitance between the first and second terminals of the second filter sub-circuit 220 may influence the signal in the feedback signal line 100. Since the third clock signal in the third clock line CLKB2 and the fourth clock signal in the fourth clock line CLK2 are inverted signals with regard to each other, the influence of the fourth clock signal on the signal in the feedback signal line 100 and the influence of the third clock signal on the signal in the feedback signal line 100 are reverse and at least partially cancel each other out.

In some embodiments, the second filter sub-circuit 220 may also include a resistor and a capacitor, one terminal of the resistor is formed as the first terminal of the second filter sub-circuit 220 to be electrically coupled to the feedback signal input terminal, the other terminal of the resistor is electrically coupled to one terminal of the capacitor, and the other terminal of the capacitor is formed as the second terminal of the second filter sub-circuit 220 to be electrically coupled to the third clock signal terminal CLKb2.

In some embodiments, the second terminal of the second filter sub-circuit 220 may be directly electrically coupled to the third clock signal line CLKB2. In some embodiments, the second terminal of the second filter sub-circuit 220 may be electrically coupled to the third clock signal line CLKB2 through the third clock signal terminal CLKb2.

The first and second filter sub-circuits 210 and 220 are shown in the embodiments of the present disclosure, but the present disclosure is not limited thereto. In some embodiments, the common voltage compensation circuit according to the embodiments of the present disclosure may further include a third filter sub-circuit electrically coupled to the feedback signal input terminal Tfeed and the fifth clock signal line CLKB3. The configuration inside the third filter sub-circuit may be similar to those of the first filter sub-circuit and the second filter sub-circuit, and the description thereof will not be repeated herein.

By using the common voltage compensation circuit according to the embodiments of the present disclosure, the signal Vscom sampled by the feedback signal line 100 is less interfered by the clock signal or even not interfered by the clock signal, and thus the feedback signal Vfeed output from the feedback signal line 100 become more consistent with the sampled signal Vscom sampled from the common electrode by the feedback signal line 100, that is, the feedback signal Vfeed output from the feedback signal line 100 become more consistent with the common voltage on the common electrode. Therefore, the effect of compensating the common voltage by using the feedback signal Vfeed output from the feedback signal line 100 is enhanced, the common voltage on the common electrode can be always kept stable, and thus the appearance of horizontal stripes on the screen displayed by the display panel can be relieved or avoided.

An embodiment of the present disclosure also provides a display driver including the common voltage compensation circuit in accordance with embodiments of the present disclosure. Therefore, by using the display driver including the common voltage compensation circuit according to embodiments of the present disclosure, the appearance of horizontal stripes on the screen displayed by the display panel driven by the display driver can be relieved or avoided.

In some embodiments, the clock signal generation sub-circuit 400 may be integrated with the common voltage compensation circuit according to embodiments of the present disclosure to simplify a circuit structure of the display device. For example, the display driver according to the embodiment of the present disclosure includes a clock signal generation sub-circuit 400. By integrating the clock signal generation sub-circuit 400 with the common voltage compensation circuit according to embodiments of the present disclosure in the display driver, the circuit configuration of the display device including the display driver and the common voltage compensation circuit according to embodiments of the present disclosure can be simplified.

In some embodiments, as shown in FIGS. 5, 7 and 8, the clock signal generation sub-circuit 400 includes the first clock signal terminal CLKb1 electrically coupled to the first clock signal line CLKB1 and the second clock signal terminal electrically coupled to the second clock signal line CLK1. The second terminal of the first filter sub-circuit 210 is electrically coupled to the first clock signal terminal CLKb1, and the second terminal of the first filter sub-circuit 210 is electrically coupled to the first clock signal line CLKB1 through the first clock signal terminal CLKb1. Therefore, the second terminal of the first filter sub-circuit 210 may not be directly coupled to the first clock signal line CLKB1, thereby simplifying a wiring layout of the display panel.

In some embodiments, as described above, the common voltage compensation circuit according to embodiments of the present disclosure further includes the second filter sub-circuit 220. In order to simplify a wiring layout of the display device, the second terminal of the second filter sub-circuit 220 can be electrically coupled to the third clock signal terminal CLKb2, and electrically coupled to the third clock signal line CLKB2 through the third clock signal terminal CLKb2.

In some embodiments, the clock signal generation sub-circuit 400 and the common voltage compensation circuit according to embodiments of the present disclosure are integrated in one chip. In this case, the clock signal generation sub-circuit 400 and the common voltage compensation circuit according to embodiments of the present disclosure may be both included in one chip of the display driver without modifying the display panel, and thus it may not be necessary to add a new wiring in the peripheral region of the display panel, which is advantageous to implement a narrow bezel of the display panel.

An embodiment of the present disclosure also provides a display device including the display panel and the display driver according to embodiments of the present disclosure. The display driver according to embodiments of the present disclosure is used to drive the display panel. The display panel includes the feedback signal line 100, the first clock signal line CLKB1, and the second clock signal line CLK 1. The feedback signal line 100 is electrically coupled to the feedback signal input terminal Tfeed, the feedback signal line 100 is adjacent to the second clock signal line CLK1, the first terminal of the first filter sub-circuit 210 is electrically coupled to the feedback signal input terminal Tfeed, and the second terminal of the first filter sub-circuit 210 is electrically coupled to the first clock signal line CLKB1. The common voltage compensation circuit according to embodiments of the present disclosure includes the first filter sub-circuit 210, so that the signal sampled from the common electrode by the feedback signal line 100 is less interfered by the clock signal or even not interfered by the clock signal, and thus the feedback signal Vfeed output from the feedback signal line 100 become more consistent with the sampled signal Vscom sampled from the common electrode by the feedback signal line 100, that is, the feedback signal Vfeed output from the feedback signal line 100 become more consistent with the common voltage on the common electrode. Therefore, the effect of compensating the common voltage by using the feedback signal Vfeed output from the feedback signal line 100 is enhanced, the common voltage on the common electrode can be always kept stable, and thus the appearance of horizontal stripes on the screen displayed by the display panel can be relieved or avoided.

In some embodiments, the display panel includes a display region and a peripheral region outside the display region, the second clock signal line CLK1 is disposed in the peripheral region, the second clock signal line CLK1 is on a side of other clock signal lines distal to the display region, and the feedback signal line 100 is on a side of the second clock signal line CLK1 distal to the display region, thereby ensuring that only the second clock signal line CLK1 is adjacent to the feedback signal line 100 to minimize the influence of the clock signal lines on the feedback signal line 100.

In some embodiments, the feedback signal line 100 is parallel to the second clock signal line CLK1 adjacent to the feedback signal line 100.

In embodiments of the present disclosure, the display panel includes the first to sixth clock signal lines CLKB1 to CLK3, but the present disclosure is not limited thereto. The number of the clock signal lines can be set according to actual requirements.

It will be appreciated that the above embodiments are merely exemplary embodiments for the purpose of illustrating the principle of the disclosure, and the disclosure is not limited thereto. Various modifications and improvements can be made by a person having ordinary skill in the art without departing from the spirit and essence of the disclosure. Accordingly, all of the modifications and improvements also fall into the protection scope of the disclosure.

What is claimed is:

1. A common voltage compensation circuit, comprising a feedback signal input terminal and a compensation sub-circuit, the feedback signal input terminal being electrically coupled to a feedback signal line and the compensation sub-circuit and being configured to receive a feedback signal related to a common voltage from the feedback signal line and to provide the received feedback signal to the compensation sub-circuit, the compensation sub-circuit being configured to generate a compensation voltage for compensating the common voltage according to the received feedback signal and a reference common voltage, wherein the common voltage compensation circuit also comprises a first filter sub-circuit, a first terminal of the first filter sub-circuit is electrically coupled to the feedback signal input terminal, and a second terminal of the first filter sub-circuit is electrically coupled to a first clock signal line, and the feedback signal line is arranged adjacent to a second clock signal line, and a first clock signal in the first clock signal line and a second clock signal in the second clock signal line are signals inverted relative to each other.

2. The common voltage compensation circuit of claim 1, wherein the first filter sub-circuit comprises a first resistor and a first capacitor, one terminal of the first resistor is formed as the first terminal of the first filter sub-circuit and is electrically coupled to the feedback signal input terminal, the other terminal of the first resistor is electrically coupled to one terminal of the first capacitor, and the other terminal of the first capacitor is formed as the second terminal of the first filter sub-circuit and is electrically coupled to the first clock signal line.

3. The common voltage compensation circuit of claim 2, further comprising a second filter sub-circuit, a first terminal of the second filter sub-circuit being electrically coupled to the feedback signal input terminal, and a second terminal of the second filter sub-circuit being electrically coupled to a third clock signal line, wherein the second clock signal line is located between the feedback signal line and a fourth clock signal line, and a third clock signal in the third clock signal line and a fourth clock signal in the fourth clock signal line are signals inverted relative to each other.

4. The common voltage compensation circuit of claim 3, wherein the second filter sub-circuit includes a second resistor and a second capacitor, one terminal of the second resistor is formed as the first terminal of the second filter sub-circuit and is electrically coupled to the feedback signal input terminal, the other terminal of the second resistor is electrically coupled to one terminal of the second capacitor, and the other terminal of the second capacitor is formed as the second terminal of the second filter sub-circuit and is electrically coupled to the third clock signal line.

5. The common voltage compensation circuit of claim 1, wherein the compensation sub-circuit comprises an operational amplifier, an inverting input of the operational amplifier is electrically coupled to the feedback signal input terminal, and a non-inverting input of the operational amplifier is configured to receive the reference common voltage.

6. A display driver, comprising the common voltage compensation circuit of claim 1.

7. The display driver of claim 6, further comprising a clock signal generation sub-circuit, wherein the clock signal generation sub-circuit comprises a first clock signal terminal electrically coupled to the first clock signal line, and the second terminal of the first filter sub-circuit is electrically coupled to the first clock signal line by being electrically coupled to the first clock signal terminal.

8. The display driver of claim 7, wherein the common voltage compensation circuit further comprises a second filter sub-circuit, a first terminal of the second filter sub-circuit is electrically coupled to the feedback signal input terminal, a second terminal of the second filter sub-circuit is electrically coupled to a third clock signal line, and the second clock signal line is located between the feedback signal line and a fourth clock signal line, and a third clock signal in the third clock signal line and a fourth clock signal in the fourth clock signal line are signals inverted relative to each other.

9. The display driver of claim 8, wherein the second filter sub-circuit includes a second resistor and a second capacitor, one terminal of the second resistor is formed as the first terminal of the second filter sub-circuit and is electrically coupled to the feedback signal input terminal, the other terminal of the second resistor is electrically coupled to one terminal of the second capacitor, and the other terminal of the second capacitor is formed as the second terminal of the second filter sub-circuit and is electrically coupled to the third clock signal line.

10. The display driver of claim 8, wherein the clock signal generation sub-circuit further comprises a third clock signal terminal electrically coupled to the third clock signal line, and the second terminal of the second filter sub-circuit is electrically coupled to the third clock signal line by being electrically coupled to the third clock signal terminal.

11. The display driver of claim 7, wherein the clock signal generation sub-circuit and the common voltage compensation circuit are integrated in one chip.

12. A display device comprising a display panel and the display driver of claim 6, the display driver being configured to drive the display panel, wherein the display panel comprises the feedback signal line, the first clock signal line, and the second clock signal line.

13. The display device of claim 12, wherein the display panel comprises a display region and a peripheral region outside the display region, the first clock signal line, the second clock signal line, and the feedback signal line are in the peripheral region, the second clock signal line is on a side of the first clock signal line distal to the display region, and the feedback signal line is on a side of the second clock signal line distal to the display region.

14. The display device of claim 12, wherein the feedback signal line is parallel to the second clock signal line.

15. The common voltage compensation circuit of claim 2, wherein the compensation sub-circuit comprises an operational amplifier, an inverting input of the operational amplifier is electrically coupled to the feedback signal input terminal, and a non-inverting input of the operational amplifier is configured to receive the reference common voltage.

16. The common voltage compensation circuit of claim 3, wherein the compensation sub-circuit comprises an operational amplifier, an inverting input of the operational amplifier is electrically coupled to the feedback signal input terminal, and a non-inverting input of the operational amplifier is configured to receive the reference common voltage.

17. The common voltage compensation circuit of claim 4, wherein the compensation sub-circuit comprises an operational amplifier, an inverting input of the operational amplifier is electrically coupled to the feedback signal input terminal, and a non-inverting input of the operational amplifier is configured to receive the reference common voltage.

18. A display driver, comprising the common voltage compensation circuit of claim 2.

19. The display driver of claim 18, further comprising a clock signal generation sub-circuit, wherein the clock signal generation sub-circuit comprises a first clock signal terminal electrically coupled to the first clock signal line, and the second terminal of the first filter sub-circuit is electrically coupled to the first clock signal line by being electrically coupled to the first clock signal terminal.

20. The display driver of claim 19, wherein the common voltage compensation circuit further comprises a second filter sub-circuit, a first terminal of the second filter sub-circuit is electrically coupled to the feedback signal input terminal, a second terminal of the second filter sub-circuit is electrically coupled to a third clock signal line, and the second clock signal line is located between the feedback signal line and a fourth clock signal line, and a third clock signal in the third clock signal line and a fourth clock signal in the fourth clock signal line are signals inverted relative to each other.

* * * * *